United States Patent [19]

Suzuki et al.

[11] 4,265,189

[45] May 5, 1981

[54] SEWING PATTERN DISPLAYING ARRANGEMENTS

[75] Inventors: Kazuo Suzuki, Higashiosaka; Hirokazu Koda, Gose; Kenichi Nakamura, Nara; Syuich Yoshikawa, Yamatokooriyama; Naoki Ohara, Toyota, all of Japan

[73] Assignees: Sharp Kabushiki Kaisha, Osaka; Aisin Seiki Kabushiki Kaisha, Aichi, both of Japan

[21] Appl. No.: 47,861

[22] Filed: Jun. 12, 1979

[30] Foreign Application Priority Data

Jun. 13, 1978 [JP] Japan ..... 53/71715

[51] Int. Cl.[3] ..... D05B 3/02; D05B 79/00

[52] U.S. Cl. ..... 112/158 E; 112/158 F; 112/158 A

[58] Field of Search ..... 112/158 E, 158 F, 158 A, 112/158 D, 121.11, 121.12; 340/762, 766, 802

[56] References Cited

U.S. PATENT DOCUMENTS

| | | | |
|---|---|---|---|
| 4,122,395 | 10/1978 | Schotz et al. | 340/762 X |
| 4,135,461 | 1/1979 | Sedlatschek | 112/158 F X |
| 4,170,950 | 10/1979 | Ozaki | 112/158 F |

FOREIGN PATENT DOCUMENTS

| | | | |
|---|---|---|---|
| 2735428 | 2/1978 | Fed. Rep. of Germany | 112/158 E |

*Primary Examiner*—Peter P. Nerbun

*Attorney, Agent, or Firm*—Birch, Stewart, Kolasch and Birch

[57] ABSTRACT

In a sewing machine capable of electrically sewing an object subject to a sewing pattern selected, sewing pattern displaying arrangements according to the present invention comprise a pattern cams unit, a pattern cam follower unit, a pattern selector mechanism, and an electric circuitry means, wherein a transient process from one sewing pattern selection to the other successive sewing pattern selection is to be displayed in a visible mode.

3 Claims, 4 Drawing Figures

SEWING PATTERN DISPLAYING ARRANGEMENTS

BACKGROUND OF THE INVENTION

This invention relates to an electrically driven sewing machine capable of electrically sewing the object subject to one of the sewing patterns optionally selected through the actuation of one of sewing pattern selection buttons thereof, or more particularly, to the sewing machine of the above-described type wherein a sewing pattern displaying arrangement capable of displaying in a visible mode a transient process from one selection of the sewing pattern to the other successive selection of sewing pattern is further provided.

In the conventional electric driven sewing machine capable of sewing the object subject to the sewing pattern selected, the respective sewing pattern is arranged to be selected from the pattern cams layered for constituting the one unit by shifting a cam follower means to a position equivalent to a layered position of the cam to be selected with the help of a conventional pattern cam selector mechanism, when the sewing pattern selection button is to be actuated.

Consequently, according to the conventional electric driven sewing machine of the above-described type, it is common to take a certain time before the successive selection from one preceding selection of the sewing patterns is to be accomplished, and thus, during the above-mentioned lapse of time, the sewing operation is not naturally to be brought about. Therefore, when the sewing machine is of the type in which the display of the successive selection is arranged not to be effected unless the selection mentioned above is to be completed, the operator of the sewing machine of the above-described type often feels uneasy, since the above-mentioned lag time inherent in the conventional sewing machine cannot be avoided. Similarly, even if the sewing machine is alternatively arranged to be of the type in which the display of the successive selection is to be simply effected soon after the actuation of the selection mentioned above is performed, the uneasy feeling of the operator is the same, since the actual accomplishment of the selection mentioned above and the successive readiness of the sewing operation are to be first brought about after the certain lag time mentioned above is finished.

SUMMARY OF THE INVENTION

Accordingly, an essential object of the present invention is to provide a sewing pattern displaying arrangement capable of displaying in a visible mode a transient process from one present selection of the sewing pattern to the other successive selection of the sewing pattern, which is to be adapted for a sewing machine capable of electrically sewing an object subject to the sewing pattern selected through an actuation of one of sewing pattern selection buttons.

Another important object of the present invention is to a provide a sewing pattern displaying arrangement of the above-described type, which comprises a combination of a simple mechanical arrangement employed for a pattern cam selection mechanism and its control circuitry arrangement constituted by a plurality of the conventional circuitry components.

A further object of the present invention is to provide a sewing pattern displaying arrangement of the above-described type, which is readily applied to any kinds of the conventional sewing machines.

A still further object of the present invention is to provide a sewing pattern displaying arrangement of the above-described type, which is highly efficient in use and, can be manufactured at low cost.

In accomplishing these and other objects according to one preferred embodiment of the present invention, in a sewing machine capable of electrically sewing an object subject to a sewing pattern selected, there is provided a sewing pattern displaying arrangement capable of displaying in a visible mode a transient process from one present selection of the sewing pattern to the successive selection of the sewing pattern.

The above-mentioned arrangement according to the present invention comprises;

a plurality of sewing pattern selection buttons for optionally selecting a sewing pattern from a plurality of sewing patterns;

a plurality of displaying members capable of correspondingly showing respective selections of the sewing patterns, the number of which is correspondingly equivalent to the number of the sewing patterns, while the respective displaying member is constituted by a respective light-emitting member;

a plurality of sewing pattern information carrying members constituting one unit, each member of which is to carry an information of the above-described sewing pattern, respectively;

at least one picking-up member for picking up one sewing pattern information from the above-mentioned plurality of the sewing pattern information carrying members;

at least one sewing pattern information carrying member selector means for transferring the picking-up member to one of the sewing pattern information carrying members specifically selected subject to an actuation of one of the pluarlity of the sewing pattern selection buttons;

a switching means including a inverter, which is arranged to produce a clock pulse, every time after the picking-up member is transferred either in the upward direction or in the downward direction on the above-mentioned unit from one to another successive sewing information carrying members;

an up-down counter means, which is arranged to count the clock pulse impressed through the above mentioned inverter either in an increment mode or in a decrement mode subject to one of the selective directions of vertical transit of the picking-up member as described hereinbelow, thereby to output a respective coded information signal corresponding to the successive selection;

a decoder circuit means with a plurality of outputs and, including corresponding number of respective inverters, with the number of the outputs of the decoder mentioned above being corresponding to the above-mentioned number of the displaying members, wherein the above-mentioned displaying member is connected to corresponding one of the above-mentioned inverters, respectively, wherein the above-mentioned decoder is to be impressed by an output from the up-down counter, thereby to convert the specific coded signal into a respective signal capable of correspondingly actuating one of the above-mentioned light-emitting members correspondingly provided for the respective displaying members through the corresponding one of the inverter;

a pattern selection switching circuit means including an encoder capable of converting a respective signal correspondingly produced through the respective actuation of the pattern selection buttons into a respective signal correspondingly carrying a specific sewing pattern information respectively coded; and a latch circuit means temporarily latching the coded sewing information signal specifically selected through the above-mentioned actuation;

a comparator capable of comparing the above-mentioned coded sewing information signal output from the pattern selection switching circuit means and the above-mentioned coded information signal corresponding to the successive selection and output from the up-down counter, while the comparator is provided with a pair of output-terminals so that two kinds of signals are capable of being selectively output from the pair of output-terminals, respectively; and a direction control circuit means including a driven circuit means for a selectively revolutional motor to cause the picking-up member to be selectively transferred in the above-mentioned mode with the help of the sewing pattern information carrying member selector means which is driven by the selectively revolutional motor; a first revolutional direction control circuit means for actuating the driven circuit means thereby to cause the selectively revolutional motor to be revolved in a first revolutional direction; and a second revolutional direction control circuit means for actuating the driven circuit means thereby to cause the selectively revolutional motor to be revolved in a relative reverse direction with respect to the first revolutional direction mentioned above, wherein one of two kinds of signals respectively effected by the comparison is specifically impressed into the first revolutional direction control circuit means while the other kind of signal being impressed into the second revolutional control circuit means, and furthermore, either one of the first and second revolutional control circuit means is provided with a circuit means to produce a mode selection pulse to convert a selective up and down counting mode of the up-down counter mentioned above.

By the arrangement as mentioned above, a transient process from one present sewing pattern selection to the other successive sewing pattern selection is to be easily displayed in a visible mode. Therefore, an operator of the sewing machine provided with the above-mentioned arrangement will not be left in an uneasy state any more during the process-period mentioned above.

BRIEF DESCRIPTION OF THE DRAWINGS

These and other objects and features of the present invention will become apparent from the following description taken in conjunction with the preferred embodiment thereof with reference to the accompanying drawings in which.

Before the description of the present invention proceeds, it is to be noted that like parts are designated by like reference numerals throughout several views of the accompanying drawings.

DETAILED DESCRIPTION OF THE INVENTION

Figure 1:
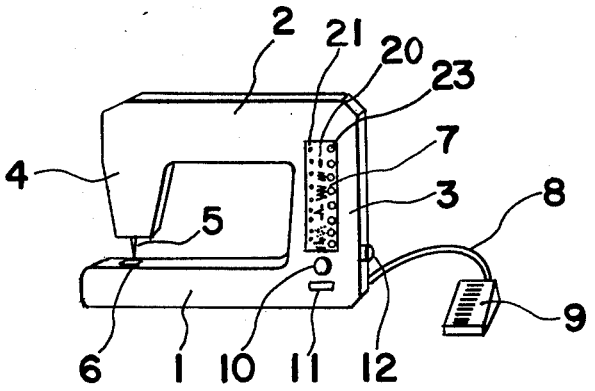
FIG. 1 is a perspective view of a sewing machine in which a sewing pattern displaying arrangement capable of displaying in a visible mode a transient process from one selection of sewing pattern to the other successive selection of sewing pattern according to the present invention is further provided.

Referring now to FIG. 1, there is shown an electrically driven sewing machine comprising a pattern selector mechanism, and its control circuitry arrangement according to the present invention, while the other constituents can be conventional as described hereinbelow.

The sewing machine mentioned above includes a main frame-work portion comprising a bed 1, and arm 2, a standard 3 rising from the bed 1 and supporting the arm 2 mentioned above, the foot switch 9 electrically connected to an electrical motor (not shown here) through an actuating signal imparting cable 8, and an electric power supply port (not shown here).

More specifically, a free end portion of the arm 2 mentioned above is configurated to form a head portion 4, in which a mechanical arrangement to cause a thread carrying needle 5 to be reciprocally moved in the substantially vertical direction and the other mechanical arrangement to cause the above-mentioned thread carrying needle 5 to be specifically moved in approximate the latent direction with respect to the feeding direction of the object to be sewn subject to a sewing pattern selected from the combination of a plurality of pattern cams and the mechanical cam follower system. The vertical reciprocal movement of the thread carrying needle 5 is effected with the help of the rotational movement of a main shaft (not shown here), while the main shaft itself is to be rotated by a main motor (not shown here) driven through a known manner. Almost beneath the spaced position of the thread carrying needle 5, there is provided a cloth feeding teeth arrangement 6, with only the tips of the above-mentioned arrangement being arranged to be protruded from a bore provided in the bed 1 as shown in FIG. 1. The feeding motion of the above-mentioned cloth feeding teeth arrangement 6 is also arranged to be effected in accordance with the movement of the main shaft driven by the main motor in a known manner. As the part of the standard 3, there is provided an operation board 7 comprising an array of buttons 20 so as to be optionally pushed for a respective selection of the specific sewing pattern from a plurality of the sewing patterns prepared in a manner as will be described hereinbelow, an array of the displaying spots 21 capable of correspondingly showing the above-mentioned specific selection, respectively, and an array of the corresponding numbers of the symbolized FIGS. 22 of the sewing patterns for the convenience sake of the respective selection mentioned above. Furthermore, besides the operation board 7 mentioned above, there are further provided a dial 10 to be employed for the sake of a small amount of manual feeding of the object to be sewn or cloth, and a button 11 to be employed for the sake of the foregoing feeding of the cloth on the front surface of the standard 3, while a manual dial 12 for permitting the above-mentioned vertical movement of the thread carrying needle 5 to be manually effected is provided on the side boundary of the standard 3 mentioned above.

As far as an operational mode of the above-mentioned sewing machine is concerned, the present electrically driven sewing machine is not so far different from those of the conventional types, and thus, the revolutional speed of the main motor together with the sewing speeds of the above-mentioned sewing arrangements connected to the main shaft mentioned above are both relatively adjustable in a known manner in proportional to the depressing degree of the foot switch 9 mentioned above, whereby the sewing operation subject to the specific sewing pattern is to be effected at a speed desired by the operator soon after the specific sewing pattern is selected.

Figure 2:
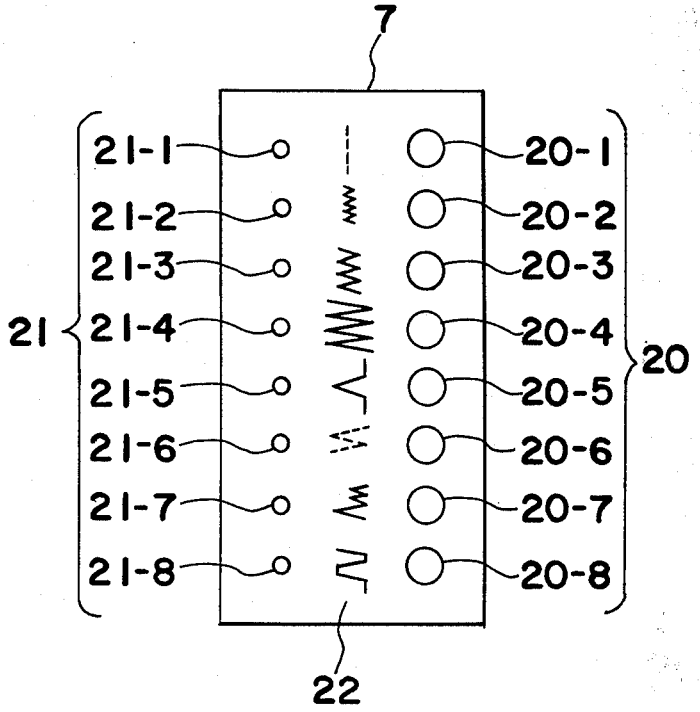
FIG. 2 is an enlarged top plan view of an operation board employed for the embodiment shown in FIG. 1 according to the present invention.

Referring now to FIG. 2, there is shown the operation board 7 comprising three arrays mentioned above in detail, wherein the buttons constituting the array 20 mentioned above are each labelled by the respective number of 20-1, 20-2, . . . , 20-8 in succession, with the displaying spots correspondingly constituting the array 21 being each labelled by the respective number of 21-1, 21-2, . . . , 21-8 in succession. The array 22 constituted by the symbolized figures of the sewing patterns, the number of which is naturally corresponding to the number of selections, is arranged to be interposed between the above-mentioned two arrays on the operation board 7.

Figure 3:
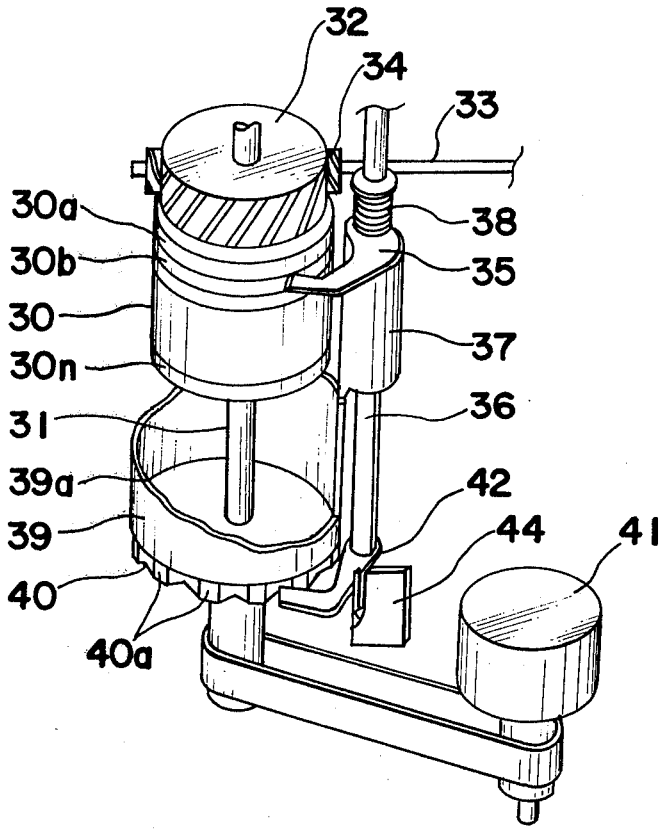
FIG. 3 is an enlarged, partial perspective view of a pattern cam selector mechanism employed for the embodiment shown in FIG. 1 according to the present invention.

Referring now to FIG. 3, there is shown a cam pattern selector mechanism including a plurality of pattern cams 30 and a cam follower 35 system according to the present invention, wherein the selection of one of the sewing patterns respectively formed on the respective pattern cams layered as the one unit, here being denoted by respective numbers of 30*a* to 30*n*, is arranged to be accomplished through the cam pattern selector mechanism in a manner as specifically described hereinbelow. More specifically, the respective specific sewing pattern is defined by means of the appropriate combination of the recess and protruded portions on the respective circumferential face of the respective cam and, thus, the plurality of the cams mentioned above are arranged to be concentrically and pivotally mounted on a shaft 31 as shown in FIG. 3.

As for the driven manner of the pattern cams unit 30, a worm gear 32 is provided for constituting the upper portion of the pattern cams unit 30 so as to make the pattern cams unit 30 to be rotationally driven as one unit, following the driven movement of the worm gear 32 mated by a worm 34 mounted on a main axle 33, while the main axle 33 itself is arranged to be rotationally driven in association with the rotation of the main motor in a known manner. Furthermore, the above-mentioned main axle 33 itself is also arranged to be employed for driving the thread carrying needle 5. Therefore, by the arrangement described in the foregoing, according to the rotational driven movement of the main motor, the pattern cams unit as the whole are rotationally driven while being arranged to be simultaneously synchronized with the driven movement of the thread carrying needle 5.

As far as the functional movement of the cam follower 35 is concerned, the cam follower 35 is arranged to oscillte in a substantially horizontal plane in accordance with the movement of a cylindrical member 37, with the one end portion of the cam follower 35 being steadily slidable on the outer circumferential surface of the specific cam selected from the pattern cams unit 30, thereby to produce selected sewing pattern information. More specifically, the cam follower 35 is secured to the cylindrical member 37 parallelly extending along the pattern cams unit 30 mentioned above at the other end portion thereof. However, the cylindrical member 37 itself is coupled to an axle 36 having a rectangular cross section in a manner such that the cylindrical member 37 mentioned above is capable of being slidably moved on the above-mentioned axle 36 in the substantially vertical direction while being forced to be rotationally moved in accordance with the rotational movement of the axle 36 mentioned above.

The cylindrical member 37 mentioned above is urged downwards through the resilient force of a spring 38 disposed above the cam follower 35, so that a local end portion of the cylindrical member 37 is to be constantly in contact with an approximately spiral locus surface 39*a* specifically forming the top shell boundary of a guiding cylindrical cam 39, which is spaced below the pattern cams unit 30 mentioned above, while the guiding cylindrical cam 39 itself is coupled to the shaft 31 with relatively rendering the concentric relationship with the pattern cams unit 30 in respect to the shaft 31 mentioned above. Furthermore, the bottom portion of the above-mentioned guiding cylindrical cam 39 is configured to form a ratchet-type cam 40 having a plurality of protruded portions 40*a* on the circumferential surface thereof.

By the arrangement described in the foregoing, the shaft 31, the guiding cylindrical cam 39, and the ratchet-typed cam 40 are all rotationally driven as one unit with the help of a selectively rotatable motor 41, whereby the cam follower 35 is to be selectively ascended and descended toward substantially vertical direction, with the local end portion of the cylindrical member 37 being frictionally driven on the approximately spiral locus surface 38*a* mentioned above, until the above-mentioned end portion of the cam follower 35 is to be brought into the contact with the circumferential surface of the predetermined specific cam. Furthermore, according to the present embodiment shown in FIG. 3, besides an arrangement that the above-mentioned axle 36 is provided with a lever 42 of click type at the lowest end portion thereof, the pitch and dimensions of the successive protruded portions 40*a* are so defined that the above-mentioned lever 42 is to be capable of being pivoted counterclockwise in synchronization with the transient period of the cam follower 35 from one specific pattern cam to the successively adjacent pattern cam, thereby to actuate a micro-switch 44 in a manner as specifically described hereinbelow. As for the arrangement described above, the micro-switch 44 is relatively arranged to space in a position to be brought into an ON-mode and thereby to be capable of producing a pulse through an actuation with the help of the lever 42 of click type, when the above-mentioned one end of the lever 42 of click type is slidably mounted onto the protruded portion 40*a* mentioned above in the course of the above-mentioned transient motion of the cam follower 35.

Such being the case, although the lever 42 of click type is brought into a free condition for a clockwise rotational movement, the lever 42 of click type is arranged to be engaged with the above-mentioned axle 36 through a conventional one-way clutch (not shown here), which is coupled to the above-mentioned axle 36, as far as a counterclockwise rotational movement is concerned.

Figure 4:
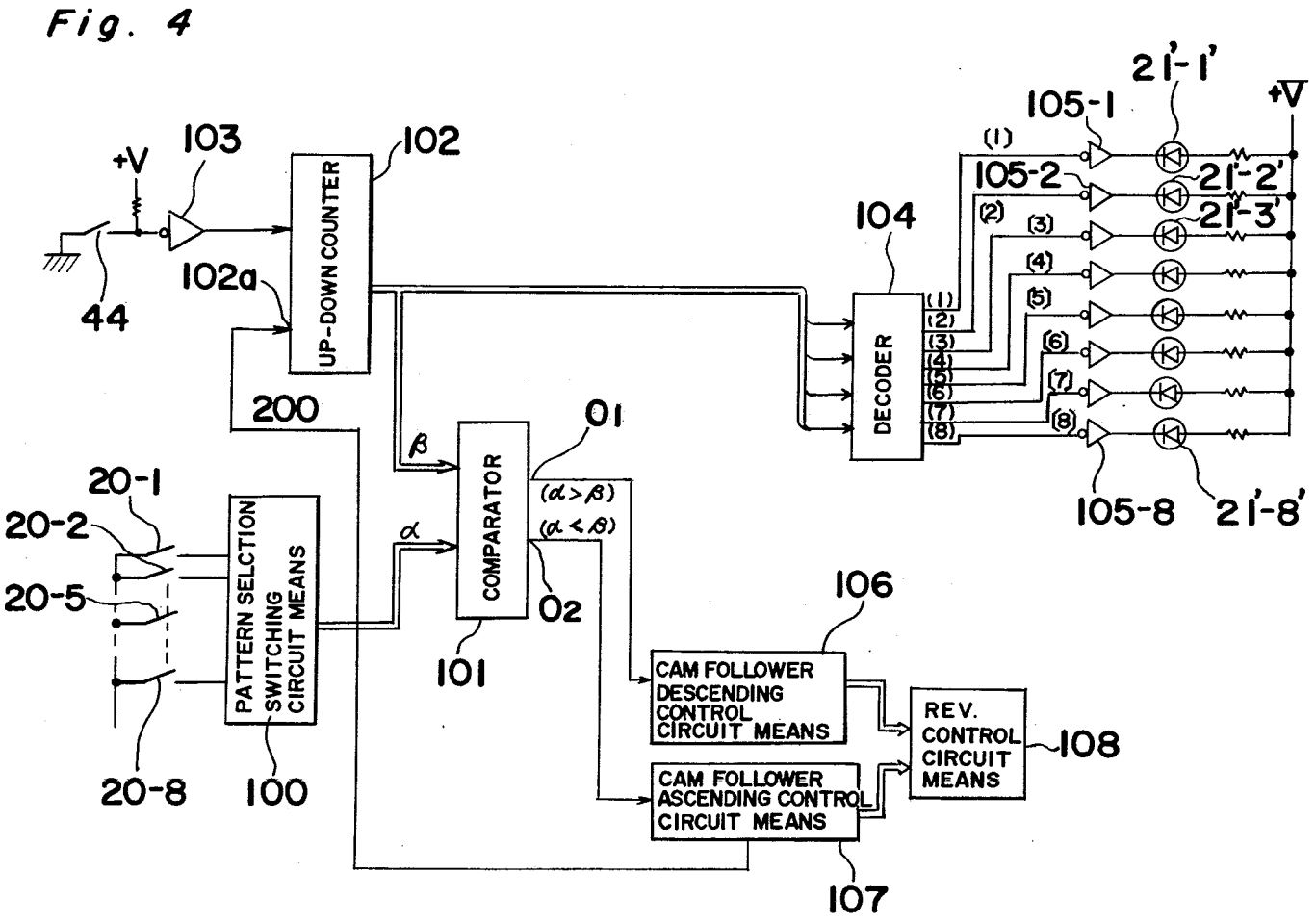
FIG. 4 is a block diagram, particularly showing an electric circuitry arrangement incorporated into the embodiment shown in FIG. 1

Referring now to FIG. 4, there is shown one embodiment of circuitry arrangements to be employed for the present invention, wherein the pattern selection buttons are respectively represented by numerals of 20-1, 20-2, . . . , 20-8, the micro-switch being represented by a numeral of 44, while the respective light emitting diode employed for the respective displaying spot described earlier is here represented by the respective numeral of 21'-1', 21'-2', . . . , 21'-8'.

According to the circuitry arrangement mentioned above, the pattern selection switches 20-1, 20-2, . . . , 20-8 are respectively connected to a pattern selection switching circuit means 100, which comprises an encoder capable of converting respective signals correspondingly produced through the respective actuations of the pattern selection buttons into the respective signals correspondingly carrying the specific sewing patterns respectively coded, and a latch circuit means temporarily latching the specific sewing information signal selected through the above-mentioned actuation.

The output signal carrying the coded sewing pattern information specifically selected, which is output from the above-mentioned pattern selection switching circuit means 100, is successively impressed onto a comparator 101.

The circuitry arrangement of the present invention further includes an up-down counter 102, which is to be successively impressed by a respective signal through a clock pulse input terminal provided therefore with the help of an inverter 103, every time after the cam follower 35 is to be vertically transferred onto the pattern cams 30*a*, 30*b*, . . . , in succession. Accordingly, the series of successive signals, which are to be successively produced in accordance with the above-mentioned vertical transit-movement of the cam follower 35, are to be successively counted either in an increment mode or in a decrement mode subject to the setting mode of the up-down counter 102 mentioned above, so that the signal information indicative of the present location of the cam follower 35 or, more specifically, the signal information indicative of the present selection of the cam selected from the pattern cams unit 30 including the cams 30*a*, 30*b*, . . . is to be periodically output.

The up or down counting mode selectively chosen for the up-down counter 102 is to be decided subject to the input signal mode of 1 or 0 to be impressed onto a terminal 102*a* provided for the above-mentioned counter 102.

The signal output from the up-down counter 102, with one of the specific sewing pattern informations, which are specifically coded with the help of the above-mentioned up-down counter 102, being carried, is arranged to be simultaneously impressed onto a decoder 104 as well as the comparator 101 mentioned earlier.

Accordingly, the comparator 101 mentioned above is to subsequently compare the coded information signal $\alpha$ output from the above-mentioned pattern selection switching circuit means 100 and the coded information signal $\beta$ output from the up-down counter 102. As the result of the comparison accomplished by the above-mentioned comparator 101, if the result is in the relation of $\alpha > \beta$, or more particularly, if the cam follower 35 is in contact with one of the relatively upper cams with respect to the cam specifically selected through one of the pattern selection switches 20-1, 20-2, . . . , 20-8, the comparator 101 is arranged to output a signal from one of the output terminals denoted by 01, while the comparator 101 is to output a signal from the other output terminal denoted by 02 in the case of the reverse result of the comparison mentioned above, i.e., $\alpha < \beta$.

According to the decoder 104 included in the circuitry arrangement of the present invention, the respective coded information signal output from the up-down counter 102, i.e., the present disposition of the cam follower 35, is to be converted into the respective corresponding signal information denoted by the respective [1] to [8], thereby to be output from the resective output terminal denoted by the respective numerals of (1) to (8).

Each terminal respectively labelled by the specific numerals of (1) to (8) is to be connected to each inverter corresponding labelled by the serial number of 105-1 to 105-8, respectively, while the respective output terminal of each inverter mentioned above is connected to a respective light emitting diode correspondingly provided and labelled by the serial number of 21'-1' to 21'-8' as mentioned earlier.

By the circuitry arrangement just described in the foregoing, the cam follower 35 is to be in contact with the circumferential surface of the uppermost cam 30*a* constituting the pattern cams unit 30, when the output of one of the inverters, for example, the output of the inverter 105-1 is rendered to be low, with the light emitting diode 21'-1' being to be simultaneously lit.

The circuitry arrangement of the present invention further includes a cam follower descending control circuit means 106, a cam follower ascending control circuit means 107, and a revolutional direction control circuit means 108 electrically connected to the selectively rotatable motor 41 as specifically shown in FIG. 3.

Such being the case, the combination of the cam follower descending control circuit means 106 and the revolutional direction control circuit means 108 is to cause the cam follower 35 to be descended in a manner as described earlier, soon after the above-mentioned cam follower descending control circuit means 106 receives a signal, which is output from the terminal 01 of the comparator 101. Similarly, the combination of the cam follower ascending control circuit means 107 and the revolutional control circuit means 108 is to cause the cam follower 35 to be ascended, soon after the above-mentioned cam follower ascending control circuit means 107 receives a signal, which is output from the terminal 02 of the comparator 101 mentioned above.

In the following, the specific functional characteristics to be brought about according to the present invention is to be described.

First, supposing, for example, a situation in which the cam follower 35 is in contact with the circumferential surface of the uppermost cam 30*a*, the content of the up-down counter 102 is so arranged that the counting content is to be correspondingly, for example, [0001], while the light emitting diode 21'-1' and thereby, the displaying spot 21-1 are both being lit, since the output terminal (1) of the decoder 104 is to here output a signal of "1".

Successively, starting from the above-mentioned situation, if the operator of the sewing machine is to actuate the pattern selection button 20-5 so as to successively select a sewing pattern correspondingly provided for a pattern cam 30*e* (not shown), a signal coded by [0101] is to be output from the pattern selection switching circuit means 100. The signal bearing the coded information $\alpha$ of [0101] mentioned above is then to be impressed onto the comparator 101 and is compared with the signal bearing the information $\beta$ of [0001], which is output from the up-down counter 102 as described earlier, whereby the signal is to be successively output from the terminal 01, since the relation of $\alpha<\beta$ is satisfied for the present case. The signal output from the terminal 01 is successively impressed onto the cam follower descending control circuit means 106 thereby to make the above-mentioned motor 41 to be rotated towards a predetermined direction, which is corresponding to a descending direction of the cam follower 35, with the help of the revolutional control circuit means 108.

More specifically, as is clear from FIGS. 3 and 4, such being the case as mentioned above, the motor 41 of the above-described type is to be actuated to rotate through the revolutional control circuit means 108 in the direction corresponding to the descending direction mentioned above. Accordingly, following the above-mentioned rotational movement of the motorf 41 of the above-described type, the shaft 31 together with the guiding cylindrical cam 39 are successively driven, whereby the cylindrical member 37 and the cam follower 35 are to be both descended along the pattern cams unit 30 due to the reason mentioned earlier, with the above-mentioned portion of the cam follower 35 being steadily in contact with the outer circumferential surface of the pattern cams unit 30. In the course of the descending movement, the micro-switch 44 is brought into an ON-mode thereby to produce one pulse at the moment when the cam follower 35 is just in transit onto the second staged pattern cam 30*b*. The pulse thus produced is to be impressed onto the up-down counter 102 with the help of the inverter 103, whereby the counting content of the up-down counter 102 is inreased by one through an increment step and, thus the output from the up-down counter 102 is rendered to be [0010]. The signal thus coded is successively impressed onto the decoder 104, whereby as the terminal denoted by (1) is rendered to be "0", with the terminal denoted by (2) being by turn rendered to be "1" through a decoding step, the light emitting diode 21'-2' is to be lit, with the light emitting diode 21'-1' being by turn to be put off.

In the same manner as described in the foregoing, following the stepwise downwards transit of the cam follower 35, the specific output terminal capable of producing the signal of "1" is to be successively transferred one by one, with the respective light emitting diodes being correspondingly lit one by one from 21'-1', to 21'-5', respectively. According to the circuitry arrangement as described in the foregoing, since the emitting transit of the light emitting diodes from one light emitting diode to the successive light emitting diode is to be clearly displayed, the operator of the sewing machine of the present invention can easily know not only the sewing pattern being momentarily under a selection, but also the transit of the successive selections of the sewing patterns, only if the operator mentioned above pays attention to the displaying state of the displaying spots denoted by 21-1 to 21-5.

Consequently, when the cam follower 35 is disposed down at the pattern cam 30*e* (not shown), the output of the up-down counter 102 is rendered to be [0101], which is to be equivalent to the coded signal of [0101] being continuously output from the pattern selection switching circuit means 100, whereby since no signal will be naturally output from the comparator 101, the revolution of the motor 41 of the above-described type is ceased and thus, the selection of the predetermined pattern cam is to be accomplished.

On the contrary to the pattern selection condition described in the foregoing, if the disposition of the pattern cam such as 30*a*, 30*b*, . . . selected through the actuation of one of the pattern selection switches such as 20-1, 20-2, . . . is relatively higher than the present disposition of the cam follower 35, the comparing result to be effected with the help of the present circuitry arrangement naturally satisfies the following relation of $\alpha<\beta$, which is the reversal relation in comparison with the result effected in the selection described earlier. Therefore, such being the case, as is clear from the description in the foregoing, since the signal to actuate the cam follower ascending circuit means 107 is to be output from the terminal 02 of the comparator 101, the motor 41 of the above-described type is to be rotated in the reverse direction with respect to that effected in the former case for the specific pattern cam selection, so that the cam follower 35 has now to be brought up to the upper predetermined disposition with respect to the present disposition. Accordingly, for the present performance to cause the cam follower 35 to be brought up to the appropriate position corresponding to that of the specific pattern cam now selected according to the present invention, the up-down counter 102 has now to be impressed by a signal of "1" output from the cam follower ascending control circuit means 107 with the help of a cable 100, so that the above-mentioned up-down counter 102 is to function as a down counter, the circuitry situation of which is specifically shown in FIG. 4.

As is clear from the description in the foregoing, according to the present invention, in the course of the successive selection of the specific pattern cam in respect to the preceedingly selected pattern cam, since the successive transits of the cam follower for the above-mentioned selection are arranged to be periodically displayed through the circuitry arrangement described in the foregoing, the operator of the sewing machine of the present invention can know not only the transit of the cam follower progressing for the selective operation, but also almost the exact time to be taken for the above-mentioned selection in a visible manner.

Therefore, the operator of the sewing machine of the present invention can now be free from an uneasy feeling or irritation, which is often brought about to the operator of the electric sewing machine of the conventional type, due to the fact that the operator mentioned above is usually left unknown for the progression of the above-mentioned selection.

Although the present invention has been fully described by way of example with reference to the accompanying drawings, it is to be noted that various changes and modifications are apparent to those skilled in the art. Therefore, unless otherwise such changes and modifications depart from the scope of the present invention, they should be construed as included therein.

What is claimed is:

1. In a sewing machine capable of electrically sewing an object subject to a sewing pattern selected, a sewing pattern displaying arrangement capable of displaying in a visible mode a transient process from one present selection of the sewing pattern to the successive selection of the sewing pattern, which comprises in combination;

a plurality of sewing pattern selection buttons for optionally selecting a sewing pattern from a plurality of sewing patterns;

a plurality of displaying members capable of correspondingly showing respective selections of said sewing patterns, the number of said displaying members being correspondingly equivalent to the number of said sewing patterns;

a plurality of sewing pattern information carrying members constituting one unit, each member of which is to carry an information of said sewing pattern, respectively;

at least one picking-up member for picking up one sewing pattern information from said plurality of said sewing pattern information carrying members;

at least one sewing pattern information carrying member selector means for transferring said picking-up member to one of said sewing pattern information carrying members specifically selected subject to an actuation of one of said plurality of sewing pattern selection buttons;

a circuitry means capable of electrically actuating in succession certain numbers of said displaying members one by one following a transferring movement of said picking-up member from one sewing pattern information carrying member presently selected to the succesively selected sewing pattern information carrying member, with said certain numbers of said displaying members respectively provided for the corresponding numbers of said sewing pattern information carrying members being correspondingly spaced between said one sewing pattern information carrying member and said successively selected sewing pattern information carrying member, said circuitry means including, a switching means including a first inverter, said switching means being arranged to produce a clock pulse, every time after said picking-up member is transferred selectively in an upward direction and in a downward direction on said unit from one to another successive sewing information carrying member;

an up-down counter means, said up-down counter means being arranged to count said clock pulse impressed through said first inverter selectively in an increment mode and in a decrement mode subject to one of said selective directions of vertical transit of said picking-up member, thereby to output a respective coded information signal corresponding to said successive selection; and a decoder circuit means provided with a plurality of outputs and including a corresponding number of second inverters, the number of said outputs of said decoder corresponding to said number of said displaying members, each of said displaying members being constituted by a respective light-emitting member and connected to a corresponding one of said second inverters, said decoder circuit means being impressed by an output from said up-down counter, thereby to convert said coded signal into a respective signal correspondingly actuating one of said light-emitting members correspondingly provided for the respective displaying member through said corresponding one of said inverters.

2. Sewing pattern displaying arrangements as claimed in claim 1, wherein said combination further comprises;

a pattern selection switching circuit means including an encoder capable of converting a respective signal correspondingly produced through the respective actuation of said pattern selection buttons into a respective signal correspondingly carrying a specific sewing pattern information respectively coded; and a latch circuit means temporarily latching said coded sewing information signal specifically selected through said actuation;

a comparator capable of comparing said coded sewing information signal output from said pattern selection switching circuit means and said coded information signal corresponding to said successive selection while being output from said up-down counter, said comparator being provided with a pair of output-terminals so that two kinds of signals are capable of being selectively output from said pair of output-terminals, respectively; and a direction control circuit means including a driven circuit means for a selectively revolutional motor to cause said picking-up member to be selectively transferred in said manner with the help of said sewing pattern information carrying member selector means which is driven by said selectively revolutional motor; a first revolutional direction control circuit means for actuating said driven circuit means thereby to cause said selectively revolutional motor to be rotated in a first revolutional direction; and a second revolutional direction control circuit means for actuating said driven circuit means thereby to cause said selectively revolutional motor to be rotated in a relative reverse direction with respect to said first revolutional direction, one of said two kinds of signals respectively effected by said comparison being specifically impressed into said first revolutional direction control circuit means while the other kind of signal being impressed into said second revolutional control circuit means, one of said first and second revolutional control circuit means being provided with a circuit means to produce a mode selection pulse to convert a selective up and down counting mode of said up-down counter with respect to each other.

3. In a pattern stitch sewing machine, a system arrangement capable of displaying in a visible mode a transient process from one present selection of the sewing pattern to the successive selection of the sewing pattern, which comprises;

a plurality of sewing pattern selection buttons for optionally selecting a sewing pattern from a plurality of sewing patterns;

a plurality of displaying members capable of correspondingly showing respective selections of said sewing patterns, the number of said displaying members being correspondingly equivalent to the number of said sewing patterns;

a plurality of sewing pattern information carrying members constituting one unit, each member of which is to carry an information of said sewing pattern, respectively;

at least one picking-up member for picking up one sewing pattern information from said plurality of said sewing pattern information carrying members;

at least one sewing pattern information carrying member selector means for transferring said picking-up member to one of said sewing pattern information carrying members specifically selected subject to an actuation of one of said plurality of sewing pattern selection buttons;

a switching means including a first inverter, said switching means being arranged to produce a clock pulse, every time after said picking-up member is transferred selectively in an upward direction and in a downward direction on said unit from one to another successive sewing information carrying member;

an up-down counter means, which is arranged to count said clock pulse impressed through said first inverter selectively in an increment mode and in a decrement mode subject to one of said selective directions of vertical transit of said picking-up member, thereby to output a respective coded information signal corresponding to said successive selection;

a decoder circuit means provided with a plurality of outputs and including corresponding number of second inverters, the number of said outputs of said decoder corresponding to said number of said displaying members, each of said displaying members being constituted by a respective light-emitting member and connected to a corresponding one of said second inverters, said decoder circuit means being impressed by an output from said up-down counter, thereby to convert said coded signal into a respective signal correspondingly actuating one of said light-emitting members correspondingly provided for the respective displaying member through said corresponding one of said inverters;

a pattern selection switching circuit means including an encoder capable of converting a respective signal correspondingly produced through the respective actuation of said pattern selection buttons into a respective signal correspondingly carrying a specific sewing pattern information respectively coded; and a latch circuit means temporarily latching said coded sewing information signal specifically selected through said actuation;

a comparator capable of comparing said coded sewing information signal output from said pattern selection switching circuit means and said coded information signal corresponding to said successive selection while being output from said up-down counter, said comparator being provided with a pair of output-terminals so that two kinds of signal are capable of being selectively output from said pair of output-terminals, respectively; and a direction control circuit means including a driven circuit means for a selectively revolutional motor to cause said picking-up member to be selectively transferred in said manner with the help of said sewing pattern information carrying member selector which is driven by said selectively revolutional motor; a first revolutional direction control circuit means for actuating said driven circuit means thereby to cause said selectively revolutional motor to be rotated in a first revolutional direction; and a second revolutional direction control circuit means for actuating said driven circuit means thereby to cause said selectively revolutional motor to be rotated in a relative reverse direction with respect to said first revolutional direction, one of said two kinds of signals respectively effected by said comparison being specifically impressed into said first revolutional direction control circuit means while the other kind of signal being impressed into said second revolutional control circuit means, one of said first and second revolutional control circuit means being provided with a circuit means to produce a mode selection pule to convert a selective up and down counting mode of said up-down counter with respect to each other.

* * * * *